US005617881A

United States Patent [19]

Kossmehl et al.

[11] Patent Number: 5,617,881

[45] Date of Patent: Apr. 8, 1997

[54] ROD FORMED SMOKING PRODUCT

[75] Inventors: Peter W. Kossmehl, Seelbach; Edgar Mentzel, Quickborn; Henning Seidel, Mechtersen; Wolfgang Wildenau, Bargfeld-Stegen; Hans Noe, Quickborn, all of Germany

[73] Assignee: H. F. & PH. F. Reemtsma GmbH Co., Hamburg, Germany

[21] Appl. No.: 320,065

[22] Filed: Oct. 7, 1994

[30] Foreign Application Priority Data

Oct. 7, 1993 [DE] Germany ..... 43 34 222/1

[51] Int. Cl.[6] ..... A24C 5/40

[52] U.S. Cl. ..... 131/328; 131/330; 131/70; 131/297; 131/352

[58] Field of Search ..... 131/358, 364, 131/365, 70, 328, 297, 352

[56] References Cited

U.S. PATENT DOCUMENTS

| | | | |
|---|---|---|---|
| 4,182,349 | 1/1980 | Selke | 131/140 |
| 4,306,578 | 12/1981 | Schmidt et al. | 131/140 |
| 4,589,428 | 5/1995 | Keritsis | 131/358 |
| 5,197,495 | 3/1993 | Ruppert et al. | 131/70 |

FOREIGN PATENT DOCUMENTS

| | | | |
|---|---|---|---|
| 0495567A2 | 3/1992 | European Pat. Off. | 131/140 |
| 168629 | 4/1905 | Germany | 131/140 |

*Primary Examiner*—V. Millin
*Assistant Examiner*—Charles W. Anderson
*Attorney, Agent, or Firm*—Merchant, Gould, Smith, Edell, Welter & Schmidt

[57] ABSTRACT

A rod-like smoking product with a strand-like filler rod of comminuted smoking tobacco and which is enclosed by a mantle of reconstituted tobacco sheets. At least one of these tobacco sheets is essentially obtained from 75 to 100% by weight of tobacco-inherent constituents including tobacco extract obtained from leaf or cut tobacco blend and tobacco rib material, and tobacco cellulose obtained from cut tobacco blend or scrap and stalk or rib material where the ratio of leaf and scrap material to stalk and rib material is in the range of 1:1.1 to 1:5.

21 Claims, No Drawings

ROD FORMED SMOKING PRODUCT

FIELD OF THE INVENTION

This invention relates to a rod-like smoking product having a filler rod made from cut or comminuted smoking tobacco surrounded by a mantle of reconstituted tobacco sheets made by a papermaking process. More specifically, this invention relates to a smoking product formed with reconstituted tobacco sheets derived from a specific ratio of tobacco materials and having improved cigarette-like taste, aroma, and sidestream smoke aroma, while preserving needed tensile strength of the reconstituted tobacco sheets.

BACKGROUND OF THE INVENTION

Reconstituted tobacco sheets are known, for example, those produced according to the paper making process disclosed in U.S. Pat. No. 4,182,349. In this process, tobacco stalks, stems, ribs, fines, and other tobacco constituents typically unusable in the manufacture of cigarettes, are reduced to fibers and extracted with hot, aqueous solutions. The hot water-soluble extract is removed, e.g. by screening, and the resultant pulp, containing the tobacco cellulose constituents, is fed to a paper-making apparatus after optional treatments such as homogenization, cleaning, or further screening. Fillers or other additives may be mixed with the pulp prior to feeding it to the paper-making machine. Concentrated hot water-soluble tobacco extract may be added to the raw tobacco sheet prior to its processing into the final tobacco sheet product.

Tobacco sheets produced by the extraction and reconstituted-sheet processes have hitherto been used in small, cut form to extend smoking tobacco in cigarettes and cigarillos, permitting previously unusable fines and ribs to be used as smokable material. Additionally, due to their uniform structure and better mechanical characteristics, reconstituted tobacco sheets have been used as outer wrappers for cigarillos. See, for example, European Patent Application EP-A-495,567, where a reconstituted tobacco sheet made by a paper-making process is used to wrap a smoking product.

However, the use of tobacco sheets as the inner or outer wrapper for smoking products has not been satisfactory for a number of reasons. For example, the starting tobacco material used to make the tobacco sheets, e.g., ribs and stalks having a sufficient cellulose content to form a sheet of sufficient mechanical strength, is inadequate from a sensory standpoint, e.g., aroma and taste, and their dark color is not and attractive or pleasing to the smoker. These smoking products have a cigar or cigarillo taste and not the desired cigarette taste.

Numerous attempts have been made to obviate these disadvantages, including enzymatic preparation of the extract, however, such attempts have hitherto not been successful. Some attempts have led to products which fail to comply with legal requirements for the smoking product.

The use of tobacco sheets as wrappers of smoking products has also been unsatisfactory with respect to tensile strength, water or saliva resistance and with respect to general smoking characteristics, including porosity, burning behavior, ash content and in particular the smoking aroma desired by the smoker.

In the smoking product described in EP-A-495 567, the tobacco sheet is formed from the pulpy extraction of essentially tobacco leaf ribs and fines. To reduce sidestream smoke, only a limited amount of the water-soluble extract is reapplied to the tobacco sheet, namely not exceeding 20% by weight of the tobacco sheet. Therefore, the taste, quality and aroma of this product is not desirable to the smoker.

Products produced using reconstituted tobacco sheets suffer from the disadvantages of unpleasing taste and obtrusive, heavy aroma of side-stream smoke, due to the type of tobacco material used to form the tobacco sheets and are not accepted by many smokers. This deterioration in taste and aroma is worsened in a tobacco product enveloped in two tobacco sheets, because the two sheets account for approximately 20% by weight of the total tobacco product and consequently influence or reduce the taste impression of its main stream smoke considerably, as well as the aroma impression of its sidestream smoke.

The instant invention solves the prior art problem described above with smoking product wrapped with reconstituted tobacco sheets having a satisfactory taste desired and expected by the smoker, and which also improves the quality of sidestream smoke.

SUMMARY OF THE INVENTION

The present invention provides an enveloped or enclosed smoking product having a reconstituted mantle formed from tobacco sheets having satisfactory cigarette-like taste, aroma, and side stream smoke. The smoking product of the present invention is so constructed with respect to physical shear characteristics that it can be economically manufactured on standard cigarette or cigarillo production lines, having satisfactory tensile strength and elongation characteristics, as well as a satisfactory burning speed and porosity making it possible to control the smoke supply.

The tobacco sheets of the rod-like smoking product of the invention are formed in a papermaking process using tobacco stalks and tobacco ribs, as well as lamina tobacco material (leaf) with a proportionate return of hot water soluble extract to the sheets ("TF-1" method) or by a novel tobacco sheet production process using exclusively lamina tobacco material extracted using cold water and without hot water extract return to the reconstituted sheet, but rather with the return of almost all of the cold water soluble constitutents of tobacco("TF-2" method).

Preferably tobacco sheets for an outer wrapper, i.e., the outer enclosure or envelope of the rod-like smoking product, are produced by the TF-1 method or process and tobacco sheets for an inner wrapper, i.e., the inner envelope or enclosure of the filler rod of the rod-like smoking product are produced by the TF-2 method or process. This surprisingly lead to an improvement in the aroma of sidestream smoke of the product compared with conventional, comparable products such as commercially available cigarillos. It is not the sidestream smoke quantity which is decisively improved, but its aroma quality. The sidestream smoke also loses its obtrusive dark, dull nature, and presents a more pleasing smoke color to the smoker.

Unexpectedly, this improvement in sidestream smoke, aroma, and color can also be obtained when much more tobacco extract is supplied or returned to the outer wrapper tobacco sheet than to the inner wrapper tobacco sheet. Thus, a mantle comprising two layers and having more than 20% by weight reapplied tobacco extract improves the side smoke qualities of a smoking product (dry weight basis of).

When the mantle of a smoking product includes at least one tobacco sheet made by the TF-2 method or process, the taste and aroma of the mainstream smoke is greatly improved. In a preferred embodiment of this invention, a smoking product includes both a sheet made by the TF-1 process and a sheet made by the TF-2 process. Most preferably, the outer wrapper is made by the TF-1 process and the inner wrapper is made by the TF-2 process. This preferred embodiment is a smoking product formed with reconstituted tobacco sheets and having improved mainstream smoke taste and aroma as well as improved side stream smoke aroma and color, as compared with prior art products utilizing reconstituted tobacco sheets.

Combinations of tobacco sheets produced by the TF-1 and TF-2 processes are useful for manufacturing a rod-like smoking product according to the invention, which gives the advantageous, surprising effects, making it easier for smokers of conventional cigarillos to change to the product according to the invention.

The TF-1 Method

In producing the rod-like smoking product of the invention, it is important that the tobacco sheet produced by the TF-1 process comprises 75 to 100% by weight of the tobacco-inherent constituents. These consist essentially of tobacco cellulose and water soluble tobacco extract. Tobacco cellulose is obtained from comminuted leaf or cut tobacco blends, scrap, tobacco stalks and tobacco rib material. The tobacco extract is preferably obtained from a comminuted leaf or cut tobacco blend and tobacco rib material. The aroma-intensive components are derived from the leaf tobacco blend and scrap, present with a particle size of approximately 1 to 5 mm and preferably 1.5 to 4 mm.

The preferred dry weight ratio of leaf tobacco blend and scrap (aroma intensive) to tobacco rib and stalk material (high in cellulose) is in the range of approximately 1:1.1 to approximately 1:5, preferably in the range of about 1:1.1 to 1:4, and most preferably in the range of about 1:1.5 to 1:2.5. It is understood that the aroma intensive component may include leaf or scrap materials, or mixtures thereof. Likewise, the cellulose component may include rib or stalk, or mixtures thereof.

In the production of tobacco sheets, by either TF-1 or TF-2, up to 20% by weight and preferably 8 to 14% by weight of extraneous cellulose such as soft wood, hemp or flax cellulose may be added. If the tobacco cellulose is completely or partly obtained from tobacco stalks, it is possible to correspondingly reduce the extraneous cellulose proportion without impairing the physical characteristics of the tobacco sheet.

The tobacco material used to produce the tobacco sheets of the present invention advantageously includes approximately 40–50% tobacco material obtained from a high-grade cut tobacco blend, for example, a blend of Virginia tobacco, Burley tobacco, Orient tobacco, or expanded ribs of Virginia tobacco. In a preferred embodiment, the mixture includes about 30–40 wt. % Virginia, about 35–55 wt. % Burley, about 5–10 wt. % Orient, and about 1–10 wt. % expanded ribs of Virginia tobacco.

To meet the strength requirements of a tobacco sheet for use as a wrapper, the proportion or tobacco stalk and rib material is somewhat higher than the leaf blend and scrap material, due to its higher cellulose content. However, the ratio of leaf or cut tobacco blend to tobacco rib or stalk material should not exceed 1:5. Excess amounts of rib and stalk material would result in undesirable aroma-specific smoking characteristics of the tobacco sheet. However, this can optionally be compensated by the addition of tobacco-inherent aroma-improving constituents of the water soluble extract during the final stage of the sheet production process. The extract is applied in a quantity of more than 20% by weight of the sheet to the high cellulose-content sheet to obtain an acceptable aroma. In an extract obtained from tobacco material having a high proportion of a lamina tobacco, the aroma-improving constituents are enriched.

The TF-2 Method

The TF-2 method for producing a tobacco sheet uses essentially exclusively lamina tobacco material. Based on the weight of the tobacco sheet, 75 to 80% by weight lamina tobacco material is comminuted and extracted soley with cold water. To the pulp is added 10 to 20% by weight of extraneous long-fibre cellulose. Almost all of the cold water extract (aroma intensive) is concentrated and returned to the reconstituted sheet. Other conventional additives such as binders, fillers and burn-off-influencing agents, as well as aromatic substances can be added in a quantity of up to 15% by weight, both during the production of the raw sheet and also subsequently at the conditioning stage.

To obtain a preferred taste, the tobacco blend used to form the tobacco sheet preferably corresponds to the composition of the leaf or cut tobacco blend of the filler rod insert tobacco. This is necessary to obtain the desired taste trend, e.g., preferably "American Blend," and is also advantageous for simple, inexpensive production of the rod-like smoking product. It is possible to produce both the mantle and the filler rod with the same tobacco blend. However, the tobacco blend composition of the tobacco sheet differ from the blend composition of the insert tobacco.

In producing the tobacco sheet both by the methods TF-1 and TF-2, it is possible to add up to 20% by weight extraneous cellulose, which leads to an improvement in the physical characteristics, e.g., (tensile strength) of the tobacco sheet.

Additives including conventional binders such as methyl cellulose, dextrins, pectins, alginates, starch, gums, amylose, carboxymethyl cellulose, honey, corn syrup or other polysaccharides; fillers such as calcium carbonate or titanium dioxide; and burn-off-influencing agents generally made of alkaline earth carbonates and alkali metal salts of weak organic acids such as alkali metal citrates or acetates may be used in either or both of the TF1 and TF2 processes. Generally, these additives are present in an amount between 0 and about 15 weight %. In a preferred embodiment, additives include up to about 12 wt % calcium carbonate, up to about 2 wt % sodium or potassium citrate or acetate, and up to about 4 wt % titanium dioxide.

It is possible to add aromatic substances including tobacco-inherent substances or extracts of tobacco blends, to the tobacco sheets, for example, by means of the apparatus of Kaymich (GB) (Kaymich applicator, model FDU SYSM). The aromatic substance is preferably in an alcoholic solution, and is preferably applied to the inside of the tobacco sheet to avoid undesired optical effects. Application may be to the whole-surface or to longitudinal strips. This sheet aromatization process can be performed in both the TF-1 and TF-2 processes.

TABLE I

Technical data of tobacco sheets TF-1 or TF-2

| | General Range | Preferred |
|---|---|---|
| Elongation in % according to DIN 53112 | 1–1.4 | 1.15–1.3 |
| Porosity according to DIN | 30–200 | 80–120 |

TABLE I-continued

| Technical data of tobacco sheets TF-1 or TF-2 | | |
|---|---|---|
| | General Range | Preferred |
| ISO 2965 in Coresta units | | |
| Weight per unit area according to DIN 53102 in 6/m² | 35–70 | 45–55 |
| Moisture according to DIN 10252 in % | 8–15 | 8–12 |
| Breaking strain according to DIN 53112 om g/2.54 cm width | min. 1000 | 1350–1600 |

In one embodiment of the invention, the strand-like filler rod of cut or comminuted smoking tobacco is enclosed only in a single tobacco sheet produced by the TF-1 process. In another embodiment of the invention, the mantle placed round the strand-like filler rod comprises one or more tobacco sheet layers, produced by the TF-1 process or by the TF-2 process. Preferably, one mantle layer, most preferably the outer layer or outer wrapper, is produced by the TF-1 process and the inner layer or inner wrapper by the TF-2 process. In the most preferred embodiment, the outer wrapper, i.e., the outermost mantle layer formed round the strand-like filler rod, is arranged spirally, whereas the inner wrapper, i.e., the innermost mantle layer, has an adhesive joint in the axial direction.

A smoking product having a filler rod enclosed with two tobacco sheets generally has the technical characteristics given in Table II.

TABLE II

| | General Range | Preferred |
|---|---|---|
| Diameter in mm | 6–9 | 7.8–8.1 |
| Length in mm | 50–250 | 55–75 |
| Mass burning speed in mg/min | 50–70 | 60 |
| Packing density of filling tobacco (rod) in mg/cm³ | 190–270 | 210–240 |

The strand-like filler rod preferably contains insert or filling tobacco having a cut width as shown in Table III.

TABLE III

| | |
|---|---|
| Mean value of blend | 2.2 mm |
| Virginia | 2.2 mm |
| Orient | 2.5 mm |
| Burley | 2.0 mm |

The pH-value of the tobacco sheet measured in an aqueous suspension is preferably about 7.0.

The enclosure, envelope or mantle of the inventive smoking product can have a final porosity, which is higher than 30 and lower than 1000 Coresta units. This product can be smoked in the same way as a conventional cigarillo, but can alternatively be inserted into a conventional cigarillo sleeve with a filter tip and then smoked. In another embodiment, the tobacco sheets of the mantle are produced in such a way that the porosity of the mantle formed of the outer and inner wrappers is very high, i.e., in a range 10,000 to 30,000 Coresta units. This smoking product cannot itself be smoked, but can be inserted into standard, known filter tipped sleeves of cigarette paper and smoked as a filter cigarillo.

The rod-like smoking product can be produced in a standard length for cigarillos. It can be provided with a standard filter mouthpiece, i.e., with a ventilated filter, preferably laser-perforated to provide a light cigarillo trend. The rod-like smoking product can also be produced in overlarge lengths, in order to subdivide them as described in German Patent 42 06 507. Moreover, as described in German Patent 41 07 027, the end can be bevelled (oblique cut), to permit easier insertion into a corresponding sleeve.

In an alternative embodiment of the invention, the smoking product is constructed in such a way that the outermost layer of the mantle is in the form of a sleeve with a filter tip. The sleeve is made of a spirally wound and/or leaf-like, at least partly bonded tobacco sheet with an axial overlap area into which the smoking tobacco rod enclosed in the inner tobacco sheet can be inserted the sleeve can optionally consist of several layers. Either the outermost layer or the inner layer tobacco sheet can be highly porous and the other layer less porous. It is also possible to adopt mixed forms with respect to the porosity, provided that a smokable product is obtained.

The invention is further described in the following examples which are not to be construed as limiting the invention, but rather illustrate various embodiment of the invention.

EXAMPLE 1

PLEASE PROVIDE MISSING DETAILS TO REPEAT THE STUDIES: TYPE OF TOBACCO-EXTRACTION DETAILS, SHEET FORMATION DETAILS

A rod-like smoking product having a single-layer mantle was produced as a cigarillo with a diameter of 8.0 mm and a strand length of 70 mm. The tobacco insert or strand-like filler rod consisted of a tobacco blend (TYPE?) with approximately 1.8% tobacco nicotine and a packing density of 210 mg/cm³, the average cut width of the rod tobacco being 60% by weight of the blend at 2.2 mm.

The single-layer mantle was an axially bonded tobacco sheet produced according to the TF-1 extraction paper process. Tobacco rib and lamina material in the amounts disclosed in Table IV was comminuted and extracted with hot water. To the extracted cellulose was added extraneous cellulose, $CaCO_3$, $TiO_2$ and sodium acetate. The slurry was provided to a papermaking machine to form sheets. Prior to drying, the extract was sprayed onto the sheet. The physical characteristics of the tobacco sheet and the composition thereof are given in the following Table IV.

TABLE IV

| | |
|---|---|
| Porosity in Coresta units | 103 |
| Weight per unit area | 47.7 g/m |
| Extract | 27.5% by weight |
| $CaCO_3$ | 6.3% by weight |
| $TiO_2$ | 4.4% by weight |
| Sodium acetate | 1.6% by weight |
| Rib | 33.3% by weight |
| Lamina | 14.2% by weight |
| Extraneous cellulose | 12.7% by weight |

These cigarillos were conditioned in the usual way with 60% relative humidity and a temperature of 21° C. and smoked by an expert panel, which gave the following evaluation:

Strong "American Blend" taste with a marked, nutty Burley nature with limited disturbing factor level and a scarcely obtrusive, pleasant sidestream smoke without the undesired cigar-like nature.

EXAMPLE 2

PLEASE PROVIDE DETAILS AS IN EXAMPLE 1

A rod-like smoking product having a two-layer mantle was produced with a diameter of 8.0 mm and a strand length of 70 mm. The tobacco insert (filler rod) once again consisted of a tobacco blend with approximately 1.8% tobacco nicotine and a packing density of 210 mg/cm$^3$, the average cut width of 60% by weight of the blend once again being 2.2 mm.

Both the inner and outer wrappers consisted of tobacco sheets produced by the TF-1 extraction paper process as described for Example 1. The outer wrapper was placed around the inner wrapper spirally with an angle of 30°.

The physical characteristics of the outer wrapper corresponded to those of the tobacco sheet described for Example 1. The tobacco sheet used as the inner wrapper and its composition are given in the following Table V.

TABLE V

| | INNER WRAPPER |
|---|---|
| Porosity in Coresta units | 76 |
| Weight per unit area | 4.18 g/m$^2$ |
| Extract | 15.4% by weight |
| $CaCO_3$ | 5.7% by weight |
| $TiO_2$ | 3.5% by weight |
| Sodium acetate | 2.0% by weight |
| Rib | 42.9% by weight |
| Lamina | 16.7% by weight |
| Extraneous cellulose | 13.8% by weight |

These cigarillos were conditioned in the usual way at 60% relative humidity and 21° C., smoked by an expert panel and given the following evaluation:

Strong "American Blend" taste like the product of Example 1 with a marked, nutty Burley nature with a low disturbing factor level and a scarcely obtrusive, pleasant sidestream smoke without an undesired cigar-like nature.

EXAMPLE 3

A smoking product identical to Example 2 was produced, but the outer and inner wrappers were interchanged.

The evaluation:

American blend character, but with less aroma than the product of Example 1, together with a cellulosic aftertaste and cellulosic aroma.

EXAMPLE 4

A smoking product identical to that of Example 2 was produced, but with a ventilated (18% filter ventilation) monoacetate filter with a length of 20 mm and a retention of 36% was provided.

It was evaluated as having:

A significantly reduced strength compared with the product of Example 2 and with a typical American Blend aroma. The roughness normally associated with an American Blend could not be detected.

EXAMPLE 5

A smoking product was produced in identical manner as that produced for Example 2, but the inner wrapper was produced without extract return, in accordance with the TF-2 method. It had a porosity of 133 Coresta units and a weight of 52 g/m$^2$. The tobacco blend consisted of 100% lamina tobacco. Based on its dry weight, apart from 10% by weight long-fibre extraneous cellulose, the tobacco sheet contained 75% by weight lamina tobacco, as well as 8.0% by weight $CaCo_3$, 3.8% by weight $TiO_2$, 1.8% by weight sodium acetate and 1.4% by weight extract.

It was evaluated as:

An American Blend, with a slight sharpness, good aroma, as in the product of Example 2, only slightly cellulosic and highly aromatic sidestream smoke.

EXAMPLE 6

A smoking product identical to that of Example 2 was produced, but the outer wrapper was produced with a different formulation in the TF-1 method. The individual values for the outer wrapper were as follows:

| | |
|---|---|
| Porosity | 78 Coresta units |
| Weight | 48.2 g/m$^2$ |
| Extract | 29.3% by weight |
| $CaCO_2$ | 5.8% by weight |
| $TiO_2$ | 1.7% by weight |
| Sodium acetate | 2.2% by weight |
| Extraneous cellulose | 15.0% by weight |
| Ribs | 27.6% by weight |
| Virginia lamina | 18.4% by weight |

It was evaluated as having:

a blend character with a slight, sweet sharpness of a typical highly aromatized US-orange leaf tobacco and with a balanced strength.

A smoking product identical to that of Example 6 was produced, but instead of an outer wrapper of tobacco rib materials and lamina, it was produced using the corresponding quantity, namely 46% by weight of tobacco stalk.

It was evaluated as having:

increased sharpness with an otherwise unchanged character of the aroma, much better surface structure and a definitely improved tensile strength processability.

A smoking product identical to that of Example 6 was produced, but the tobacco rib proportion of 27.6% by weight was replaced by the same amount of tobacco stalk.

The sensory evaluation was the same as that obtained for the product of Example 6. With regard to the surface structure and processability the product roughly corresponded to that of Example 7.

We claim:

1. A rod-shaped smoking product comprising:

a) a strand-like filler rod of cut or comminuted smoking tobacco; and b) a mantle comprising one or more layers of reconstituted tobacco sheets, wherein at least one layer comprises:

i) about 75–100% by weight of tobacco constituents including tobacco cellulose and tobacco extract, wherein the tobacco cellulose is obtained from the group consisting of tobacco leaf, scrap, rib, stalk, and mixtures thereof, where the ratio of leaf and scrap material to rib and stalk material is in the range of approximately 1:1.1 to 1:5;

ii) about 20% by weight or greater of a water-soluble tobacco extract;

iii) 0 to about 20% by weight of extraneous cellulose material; and iv) 0 to about 15% by weight of additives selected from the group consisting of binders, fillers, burn-off agents, and aromatic substances.

2. A rod-shaped smoking product comprising:

a) a strand-like filler rod of cut or comminuted smoking tobacco; and b) a mantle comprising an outermost wrapper formed of reconstituted tobacco sheets wound spirally around the smoking product at an acute angle to its longitudinal axis; and an inner wrapper formed of an axially bonded reconstituted tobacco sheet, wherein at least one wrapper comprises about 75–100% by weight of tobacco constituents including tobacco cellulose and tobacco extract, the tobacco cellulose obtained from the group consisting of tobacco leaf, scrap, rib, stalk, and mixtures thereof, where the ratio of leaf and scrap material to rib and stalk material is in the range of approximately 1:1.1 to 1:5, and wherein about 20% by weight or greater is a water-soluble tobacco extract.

3. The smoking product of claim 2, wherein the porosity of the mantle formed by the inner and outer wrappers is greater than about 30 and less than about 1,000 Coresta units and the smoking product can itself be smoked.

4. The smoking product of claim 2, wherein the porosity of the mantle formed from the inner and outer wrappers is above about 10,000 Coresta units and is not itself smokeable.

5. The smoking product of claim 1, wherein the ratio of leaf and scrap material to rib and stalk material is in the range of approximately 1:1.5 to 1:2.5.

6. The smoking product of claim 1, wherein the leaf and scrap material comprises about 30 to 40% by weight Virginia tobacco, about 35 to 55% by weight Burley tobacco, about 5 to 10% by weight Orient tobacco and about 1 to 10% by weight expanded ribs of Virginia tobacco, with a particle size of at least about 1.75.

7. The smoking product of claim 1, wherein the tobacco rib material is derived essentially from heat-treated Virginia tobacco ribs having a length of approximately 30 mm.

8. The smoking product of claim 1, wherein said water-soluble tobacco extract is derived from tobacco leaf, scrap, rib material or mixtures thereof.

9. The smoking product of claim 8, wherein the tobacco extract comprises:

a) a water-soluble extract of comminuted leaf and rib material; and b) volatile aromatic substances extracted from tobacco material.

10. The smoking product of claim 8, wherein the tobacco extract is obtained from tobacco leaf, scrap and rib material in a weight ratio of 1:5 lamina and scrap material to rib material.

11. The smoking product of claim 1, wherein the tobacco sheet comprises up to about 12% by weight of calcium carbonate; and up to about 2% by weight of sodium or potassium citrate or acetate.

12. A rod-shaped smoking product comprising:

a) a strand-like filler rod of cut or comminuted smoking tobacco; and b) a mantle comprising a first and a second layer of reconstituted tobacco sheets, wherein i) the first sheet comprises about 75–100% by weight of tobacco cellulose and tobacco extract, wherein the tobacco cellulose is derived from tobacco leaf, scrap, rib, stalk, and mixtures thereof, where the ratio of leaf and scrap material to rib and stalk material is in the range of about 1:1.1 to 1:5 and 20% by weight or greater is a water-soluble tobacco extract, and ii) the second layer comprises about 75 to 80% by weight of tobacco constituents including tobacco cellulose and tobacco extract, the tobacco cellulose derived from leaf tobacco substantially comprising lamina, about 10 to 20% by weight of long-fibre cellulose and 0 to about 15% by weight of additives selected from the group consisting of binders, fillers, burn-off influencing agents and aromatic substances.

13. The smoking product of claim 12, wherein the about 75 to 80% by weight of leaf tobacco includes cold-water extracted cellulose constituents formed into the sheet and cold-water extract added back to the formed sheet.

14. The smoking product of claim 12, wherein the long-fibre cellulose is derived from Manila hemp, sisal, flax, hemp, soft wood or mixtures thereof.

15. The smoking product of claim 12, wherein said second layer contains up to about 12% by weight calcium carbonate; and up to about 4% by weight titanium dioxide; and up to about 2% by weight sodium or potassium citrate or acetate.

16. The smoking product of claim 12, wherein the tobacco blend composition of the second layer corresponds to that of the cut tobacco blend of the filler rod.

17. The smoking product of claim 1, further comprising: a filter mouthpiece.

18. The smoking product of claim 1, wherein the smoking tobacco of the filler rod has an average cut width of approximately 2.2 mm.

19. The smoking product of claim 1, wherein the filler rod comprises one or more tobacco varieties selected from Burley, Blahtabak, Virginia, and Orient varieties, each having an average cut width of from about 2.0 mm to about 2.5 mm.

20. The smoking product of claim 1, wherein the outermost layer of the mantle is in the form of a sleeve provided with a filter, the sleeve formed of a spirally wound or leaf-like, at least partly bonded tobacco sheet with an axial overlap area, into which can be inserted the smoking tobacco filler rod surrounded by the inner tobacco sheet.

21. A filter cigarette comprising:

a) a strand-like filler rod of cut or comminuted smoking tobacco; and b) a mantle comprising one or more layers of reconstituted tobacco sheets, wherein at least one layer comprises:

about 75–100% by weight of tobacco constituents including tobacco cellulose and tobacco extract, the tobacco cellulose derived from tobacco leaf, scrap, rib, stalk, and mixtures thereof, where the ratio of leaf and scrap material to rib and stem material is in the range of about 1:1.1 to 1:5, and where 20% by weight or greater is water soluble tobacco extract;

c) a filter mouthpiece, and d) a filter cigarette tube or sleeve made of cigarette paper and attached to one end of the cigarette tube or sleeve for insertion of the smoking product.

* * * * *

UNITED STATES PATENT AND TRADEMARK OFFICE
CERTIFICATE OF CORRECTION

PATENT NO. : 5,617,881 PAGE 1 of 2

DATED : April 8, 1997

INVENTOR(S) : Kossmehl et al.

It is certified that error appears in the above-identified patent and that said Letters Patent is hereby corrected as shown below:

Col. 8, line 42: insert --EXAMPLE 8-- (as a new line) after the word "processability"

Col. 8, line 63, claim 1: delete ";" after the numerals "1:5"

Col. 8, line 63, claim 1: insert --, and wherein the tobacco extract is present in an amount of-- after the numeral "1:5"

Col. 8, line 64, claim 1: delete "ii)" before the word "about"

Col. 8, lines 64-65, claim 1: delete "of a water-soluble tobacco extract" after the word "greater"

Col. 8, line 66, claim 1: "iii)" before the numeral "0" should read --ii)--

Col. 9, line 1, claim 1: "iv)" before the numeral "0" should read --iii)--

Col. 9, line 20, claim 2: insert --the tobacco extract is present in an amount of-- after the word "wherein"

UNITED STATES PATENT AND TRADEMARK OFFICE
CERTIFICATE OF CORRECTION

PATENT NO. : 5,617,881 PAGE 2 of 2

DATED : April 8, 1997

INVENTOR(S) : Kossmehl et al.

It is certified that error appears in the above-identified patent and that said Letters Patent is hereby corrected as shown below:

Col. 9, lines 20-21, claim 2: delete "is a water soluble tobacco extract" after the word "greater"

Col. 10, line 6, claim 12: insert --wherein the tobacco extract is present in an amount of about-- after the word "and"

Col. 10, line 7, claim 12: delete "is a water-soluble tobacco extract" after the word "greater"

Col. 10, line 57, claim 21: insert --the tobacco extract is present in an amount of about-- after the word "where"

Col. 10, line 58, claim 21: delete "is water soluble tobacco extract" after the word "greater"

Signed and Sealed this

Twenty-fourth Day of February, 1998

*Attest:*

Bruce Lehman

BRUCE LEHMAN

*Attesting Officer*

*Commissioner of Patents and Trademarks*